United States Patent [19]

Schedele

[11] 4,389,626

[45] Jun. 21, 1983

[54] ELECTROMAGNETIC RELAY WITH ADJUSTABLE CONTACTS IN A CLOSED CONTACT CHAMBER

[75] Inventor: Helmut Schedele, Diessen, Fed. Rep. of Germany

[73] Assignee: Siemens Aktiengesellschaft, Berlin & Munich, Fed. Rep. of Germany

[21] Appl. No.: 323,283

[22] Filed: Nov. 20, 1981

[30] Foreign Application Priority Data

Jan. 22, 1981 [DE] Fed. Rep. of Germany ..... 3102011

[51] Int. Cl.[3] ..... H01H 51/22

[52] U.S. Cl. ..... 335/78; 335/202

[58] Field of Search ..... 335/202, 78–80, 335/179

[56] References Cited

U.S. PATENT DOCUMENTS

| | | | |
|---|---|---|---|
| 3,522,564 | 8/1970 | Mori et al. | 335/153 |
| 4,075,586 | 2/1978 | Sauer | 335/79 |
| 4,215,329 | 7/1980 | Kobler | 335/79 |

*Primary Examiner*—Harold Broome

*Attorney, Agent, or Firm*—Hill, Van Santen, Steadman, Chiara & Simpson

[57] ABSTRACT

An electromagnetic relay has a coil core body with a hollow interior and a movable contact element disposed in the interior approximately parallel to the longitudinal axis of the core body, the movable contact element having one end fixed in a vertical wall which closes one end of the hollow interior. The free movable end of the movable contact element makes and breaks with two stationary contacts embedded in an encapsulation wall which closes the other end of the hollow interior. The encapsulation wall is comprised of two separate adjacent parts, one part being formed as a part of the one-piece core body and the other part being separately manufactured and being inserted in place to encapsulate the hollow interior. The encapsulation wall has recesses permitting exterior access to the stationary contacts for adjustment purposes. After adjustment, pole plates are inserted into the recesses for ferromagnetically coupling the stationary contacts to a permanent magnet as well as to a ferromagnetic housing cover. The entire relay is sealed with casting compound.

10 Claims, 5 Drawing Figures

ELECTROMAGNETIC RELAY WITH ADJUSTABLE CONTACTS IN A CLOSED CONTACT CHAMBER

BACKGROUND OF THE INVENTION

1. Field of the Invention

The present invention relates to electromagnetic relays, and in particular to electromagnetic relays having a one-piece coil body comprised of insulating material which has a movable contact disposed in a hollow interior thereof which makes and breaks with one or more stationary contacts also disposed within the core body.

2. Description of the Prior Art

Electromagnetic relays are known which include a one-piece coil body comprised of insulating material which have a ferromagnetic armature contact element disposed in a hollow interior thereof, the armature contact element being secured at one end by means of insertion into an end face which closes one end of the hollow interior. The movable contact is disposed approximately parallel to the longitudinal axis of the coil core body and makes and breaks with one or more stationary contact elements disposed at an opposite end of the coil core body which are partially embedded in an opposite wall which closes the other end of the hollow interior.

It is known from U.S. Pat. No. 3,522,564 to manufacture electromagnetic relays of the type described above by making the coil core body in two halves, with one of the cooperating contacts being embedded in each half and joining the halves during an assembly process. This conventional structure has the disadvantage that after the two coil body halves are joined, the cooperating contacts are no longer accessible for adjustment. If both cooperating contacts are injected in a one-piece coil body, the contacts can be made accessible for the purpose of cleaning by means of an opening at one end face of the coil body, however, the contact clearance cannot be adjusted in such a structure. A further disadvantage of such structures is that simultaneous injection molding of the two contact plates is difficult during manufacture.

SUMMARY OF THE INVENTION

It is an object of the present invention to provide an electromagnetic relay in which a movable contact element is disposed in a hollow interior of an insulating coil core body and is affixed to a vertical wall closing one end of the hollow interior in which the stationary contacts are embedded in an encapsulation wall which closes the opposite end of the hollow interior in simple injection technology which permits sealing of the hollow interior contact chamber in a simple manner and which further permits adjustment of the contact plates within certain limits even after the contact chamber has been closed.

The above object is inventively achieved in an electromagnetic relay in which encapsulation of the contact chamber is effected by an encapsulation wall consisting of two parts with a division between the parts extending approximately through the coil central axis. The first part of the encapsulation wall is part of a one-piece formation of the coil core body which is a projection of the coil flange which holds the coil in place and which carries a first contact plate embedded therein which serves as one stationary contact for the relay. The second part of the encapsulation wall carries a second contact plate, which serves as another stationary contact, the second contact plate being embedded in the second part as a separately fabricated closing piece. Both the projection of the coil body which carries the first contact plate and the separate closing piece which carries the second contact plate exhibit a continuous recess extending from an exterior of the closed coil body to the hollow interior thereof.

As stated above, the coil body itself is manufactured in one piece with only one half of the encapsulation wall being formed during this step of the manufacturing process, which has the first contact plate embedded therein. The second half of the encapsulation wall is put in place to close the interior of the coil body. By so doing, only one of the contact plates is embedded in the coil body, thus permitting a relatively simple injection molding process for making the coil body. The separate closing piece similarly has only one contact plate embedded therein and can thus also be manufactured in a simple injection molding technology. The connection of the two encapsulating parts for the contact chamber is undertaken by means of the abuttment of the synthetic surfaces of the two mating parts, which are easy to seal.

It is still possible, however, after joining the parts and closing the interior of the relay to adjust the position of the contact plates by virtue of the fact that the contact plates are exposed in recesses disposed in each of the portions of the encapsulation wall in that area which carries the contact surfaces. By means of adjustment by mechanical pressure with an appropriate tool, the contact clearance can be reduced in a step-by-step manner as needed from the exterior of the relay. Although adjustment is permitted only in one direction, this is sufficient if tolerances which are within conventional injection molding technology are adhered to during fabrication of the parts. The hollow interior of the coil body which forms the contact chamber is, however, already closed during the course of this adjustment operation, because the recesses in the two encapsulation wall parts are sealed by means of the contact plates which are embedded at the rims of the respective recesses on all sides.

At least one of the contact plates is preferably ferromagnetically coupled to a flux guidance element which may be a housing cover for the relay. The ferromagnetic coupling which serves the purpose to close the excitation circuit can ensue over the entire contact plate, if the contact plate is itself ferromagnetic, or can ensue via an additional pole plate. In a preferred embodiment, the relay is a polarized relay, whereby the coil body projection and the closing piece form a common hollow space for accepting a permanent magnet. In this embodiment, respective pole plates are preferably disposed in the recesses of the projection and of the closing piece, the pole plates respectively being disposed with one end in contact with a contact plate and being conducted at their respective opposite ends to a pole of the permanent magnet. By means of appropriate shaping, the pole plates can simultaneously effect the coupling of the excitation flux to the flux guidance element, for example, the housing cover. The pole plates are preferably of a Z-shape, however, other shapes may be selected as may be required by other relay structures.

It is necessary to provide an electrical insulation of the contact plates in the magnetic coupling to the housing cover, which electrical insulation can be guaranteed, for example, by means of a foil disposed between the contact plate and the pole plate, or between the pole plate and the housing cover. After the pole plates have been incorporated into the recesses of the coil body and the closing piece, and after adjustment of the respective contact plates, the recesses are filled with casting compound.

The movable contact element is secured to an elongated flux plate which is inserted in the coil body through the end face which is integrally formed as part of the one-piece fabrication process. The insertion opening can then be covered, for example, with a plastic foil or wool and is then sealed with casting compound. The flux plate, which extends approximately parallel to the movable contact element inside the coil body, may also carry an additional auxiliary magnet which influences the movable contact element and makes mechanical adjustment unnecessary. Auxiliary magnets may also be provided in the recesses of the coil body projection and the closing piece. The magnetic properties of the auxiliary magnets can also be selected to eliminate the necessity of mechanical adjustment of the movable contact element.

DESCRIPTION OF THE PREFERRED EMBODIMENTS

Figure 1:
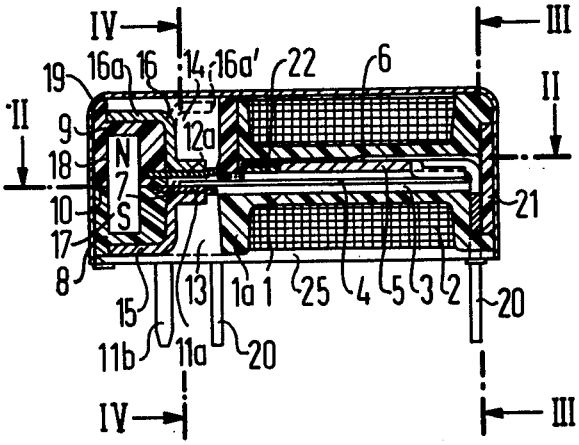
FIG. 1 is a sectional view of an electromagnetic relay constructed in accordance with the principles of the present invention.
Figure 3:
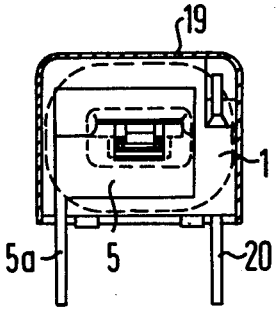
FIG. 3 is a sectional view taken along line III—III of FIG. 1.
Figure 2:
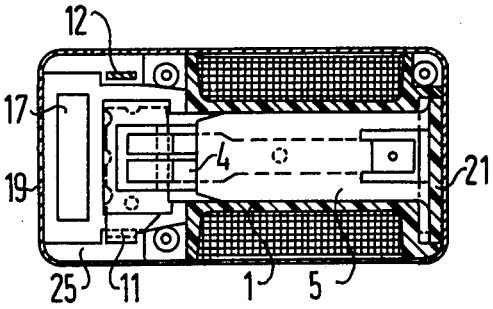
FIG. 2 is a sectional view taken along line II—II of FIG. 1.
Figure 4:
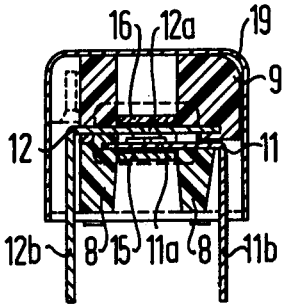
FIG. 4 is a sectional view taken along line IV—IV of FIG. 1.

A relay constructed in accordance with the principles of the present invention is shown in various sectional views in FIGS. 1 through 4. The relay has a one-piece coil core body 1 on which the coil winding 2 is wound and which has a hollow tube-like interior 3 in which a movable contact element 4 is disposed approximately parallel to the longitudinal axis of the body 1. The movable contact 4 is secured to a carrier 5 at one end, the carrier 5 acting as a flux guidance plate parallel to the movable contact. The carrier 5 is seated in grooves 6 of the coil body 1 and is secured therein by means of a press fit. A terminal 5*a* is formed by an extension of the carrier 5 to the exterior of the relay.

The free end of the movable contact 4 extends into a contact chamber 7 disposed at an end face of the body 1 in the region of a coil body flange 1*a*. The contact chamber 7 thus is a continuation of the hollow interior 3 of the coil body. Encapsulation of this contact chamber 7 is achieved by an encapsulation wall consisting of a projection 8, which is also formed as part of the one-piece coil body from the flange 1*a*, and a separately fabricated closing piece 9. The plane 10 between the projection 8 and the closing piece 9 is disposed approximately at the axis of the coil body 1.

A contact plate 11 is embedded in the coil body projection 8 such that a contact section 11*a* of the plate 11 is exposed in the contact chamber 7 and forms a contact surface which is disposed opposite to the free end of the movable contact element 4. Similarly, a contact plate 12 is embedded in the closing piece such that a contact section 12*a* of the plate 12 forms a contact surface in the contact chamber 7. A contact pin 11*b* leading to the exterior of the relay is formed as an extension of the contact plate 11 and a contact pin 12*b*, also extending to the exterior of the relay, is formed as an extension of the contact plate 12. The contact sections 11*a* and 12*a* are embedded with their edges respectively in the coil body projection 8 and the closing piece 9, whereas the central part of those contact sections 11*a* and 12*a* lies exposed toward the inside of the relay in the contact chamber 7. In order to accommodate the plate 11, the coil body projection 8 has a continuous recess 13 extending from an exterior of the coil body 1 up to the contact section 11*a*, and the closing piece 9 exhibits a similar recess 14 which proceeds from the exterior of the closing piece 9 through to the contact section 12*a*.

Z-shaped pole plates 15 and 16 are inserted into the respective recesses 13 and 14 and rest flat against the respective contact sections 11*a* and 12*a* at one end. The pole plates 15 and 16 are connected at their respective other ends to respective poles of a permanent magnet 17. The permanent magnet 17 is disposed in a magnet chamber 18 which is formed by the coil body projection 8 and the closing piece 9. The two pole plates 15 and 16, which are simply inserted from the outside into the recesses 13 and 14, have the object of conducting the permanent magnet flux to the contact plates 11 and 12. The pole plates 15 and 16 perform the simultaneous function of closing the excitation flux circuit between the movable contact element 4 and a ferromagnetic housing cover 19.

One of the pole plates 15 or 16 may be eliminated for monostable operation of the relay. In order to achieve greater sensitivity for such monostable operation, however, the pole plate 16 could, for example, exhibit a U-shape instead of the Z-shape. Such a modification is shown in FIG. 1 by the arm 16*a*′, shown in dashed lines, which is bent in a direction opposite to that normally occupied by the arm 16*a*. The arm 16*a*′ effects a direct coupling of the pole plate 16 to the housing cover 19. An electrical insulation between the contact plate 12 and the housing cover 19 must be insured, however, and such electrical insulation can be achieved, for example, by means of a foil (not shown in the drawings) inserted between the pole plate arm 16*a*′ and the housing cover 19.

During assembly of the relay, only the contact plate 11 is injected into the coil body 1 in the projection 8, as is a coil connection pin 20. The coil body 1 is then wound with the winding 2 and, insofar as the contact plate 11 is thereby contaminated, it is still easily accessible for cleaning. The carrier 5, which functions as a flux guidance plate for the magnetically conductive movable contact element 4, is then inserted into the coil body 1. The interior of the coil body is then closed by placing the closing piece 9 in place, which carries the magnetically conductive contact plate 12 which has been injected into the closing piece 9 during the fabrication of that piece. By pressing the synthetic parts against one another, the contact chamber 7 is already substantially sealed, and the opposite end face of the coil body 1 can be covered with a non-woven fabric or plastic foil 21. The permanent magnet 17 must of course be inserted into the magnet chamber 18 before the closing piece 9 is pressed in place.

After assembly of the closing piece 9, the contact clearance between the contact sections 11*a* or 12*a* may be reduced by pressing the contact sections 11*a* or 12*a* through the recesses 13 or 14 with an adjustment tool. Such adjustment of the contact clearance can be undertaken in a step-by-step manner, with the contact clearance being measured between adjustments by suitable means. The position of the movable contact element 4 can be adjusted at the point at which that element is secured to the coil body by means of suitable adjustment before the coil body 1 is closed at the opposite end.

After insertion of the pole plates 15 and 16, the housing cover 19 is put in place and any empty spaces are filled with casting compound 25. In particular, the recesses 13 and 14 are filled with such casting compound.

In order to avoid mechanical adjustment of the movable contact element 4, adjustment of this element can be undertaken magnetically by an auxiliary permanent magnet 22 which is disposed, for example, at the flux plate 5, which effects a monostable switching behavior of the relay.

Figure 5:
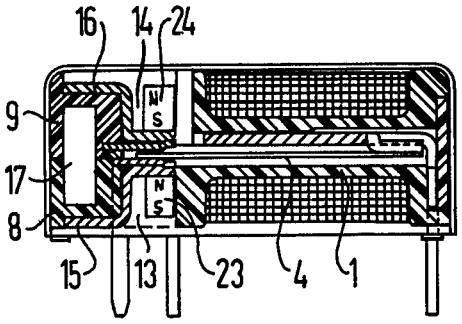
FIG. 5 is a further embodiment of the electromagnetic relay shown in FIG. 1 which employs two auxiliary magnets.

A further embodiment which avoids mechanical adjustment of the contact clearance is shown in FIG. 5 which employs auxiliary permanent magnets 23 and 24 disposed in the recesses 13 and 14 for magnetically influencing the relay operation in accordance with the selected magnetic characteristics of the auxiliary magnets 23 and 24. All other elements of the relay shown in FIG. 5 are identical to those previously described above.

Although modifications and changes may be suggested by those skilled in the art it is the intention of the inventor to embody within the patent warranted hereon all changes and modifications as reasonably and properly come within the scope of his contribution to the art.

I claim as my invention:

1. An electromagnetic relay comprising:

a one-piece coil core body comprised of insulating material and having a hollow interior and a closed end face and a partially open end face;

a ferromagnetic movable contact element having a first end secured in said closed end face of said coil core body, said movable contact element being disposed substantially parallel to a longitudinal axis of said coil core body;

a contact chamber communicating with said hollow interior of said coil core body disposed adjacent to said partially open end face of said coil core body; and an encapsulation wall for said contact chamber coincident with said partially open end face, said encapsulation wall having a first part which is a projection of said one-piece coil body and carrying a first stationary contact plate, and a second part which is separately fabricated and inserted in said encapsulation wall for closing said contact chamber, said second part carrying a second contact plate, said first and second parts having a boundary extending through said longitudinal axis, and each of said first and second parts having a continuous recess extending from an exterior of said relay to a respective one of said first and second contact plates for permitting external adjustment of the position of said contact plates after closure of said contact chamber.

2. The relay of claim 1 further comprising a flux guidance element which is ferromagnetically coupled to at least one of said contact plates.

3. The relay of claim 2 wherein said flux guidance element is a ferromagnetic housing cover.

4. The relay of claim 1 wherein said first and second parts of said encapsulation wall in combination form a magnet chamber, and further comprising a permanent magnet disposed in said magnet chamber.

5. The relay of claim 4 further comprising a pair of pole plates respectively disposed in said recesses of said first and second parts of said encapsulation wall, said pole plates each having an end in contact with respective contact plates and each having an opposite end in contact with respective poles of said permanent magnet.

6. The relay of claim 5 further comprising a ferromagnetic housing cover and wherein at least one of said pole plates is magnetically couple flush with said housing cover.

7. The relay of claim 1 wherein said recesses in said first and second parts of said encapsulation wall are at least partially filled with casting compound.

8. The relay of claim 1 further comprising an elongated flux plate carried in said coil core body in contact with said movable contact element.

9. The relay of claim 8 further comprising an auxiliary permanent magnet in contact with said elongated flux plate disposed in said coil core body.

10. The relay of claim 1 further comprising a pair of auxiliary permanent magnets respectively disposed in said recesses in said first and second parts of said encapsulation wall.

* * * * *